US011365726B2

(12) United States Patent
Buldrini et al.

(10) Patent No.: US 11,365,726 B2
(45) Date of Patent: Jun. 21, 2022

(54) ION THRUSTER

(71) Applicant: ENPULSION GmbH, Wiener Neustadt (AT)

(72) Inventors: Nembo Buldrini, Pottendorf (AT); Florin Plesescu, Wiener Neustadt (AT)

(73) Assignee: ENPULSION GmbH, Wiener Neustadt (AT)

( * ) Notice: Subject to any disclaimer, the term of this patent is extended or adjusted under 35 U.S.C. 154(b) by 144 days.

(21) Appl. No.: 16/771,339

(22) PCT Filed: Jul. 24, 2018

(86) PCT No.: PCT/AT2018/060159
§ 371 (c)(1),
(2) Date: Jun. 10, 2020

(87) PCT Pub. No.: WO2019/113617
PCT Pub. Date: Jun. 20, 2019

(65) Prior Publication Data

US 2020/0340459 A1 Oct. 29, 2020

(30) Foreign Application Priority Data

Dec. 12, 2017 (AT) ..... 60138/2017

(51) Int. Cl.
*F03H 1/00* (2006.01)

(52) U.S. Cl.
CPC ..... *F03H 1/0012* (2013.01); *F03H 1/005* (2013.01)

(58) Field of Classification Search
CPC ..... F03H 1/005; F03H 1/0012; B64G 1/405
See application file for complete search history.

(56) References Cited

U.S. PATENT DOCUMENTS

2005/0257515 A1 11/2005 Song
2012/0144796 A1 6/2012 Marrese-Reading et al.
2013/0228700 A1 9/2013 Lozano et al.

FOREIGN PATENT DOCUMENTS

WO WO9963222 A1 12/1999

OTHER PUBLICATIONS

Betto "Porous Tungsten Crown Multiemitter Testing Programme Using Three Different Grain Sizes and Sintering Procedures" (Year: 2011).*
Dandavino "Progress Towards a Miniaturized Electrospray Thruster for Propulsion of Small Spacecraft" (Year: 2012).*
(Continued)

*Primary Examiner* — Arun Goyal
*Assistant Examiner* — William L Breazeal
(74) *Attorney, Agent, or Firm* — Hoffmann and Baron, LLP

(57) ABSTRACT

The present invention relates to an ion thruster for propulsion of spacecrafts, including: a reservoir for a propellant, an emitter for emitting ions of the propellant, the emitter having one or more projections of porous material and a base with a first side supporting said projections and a second side connected to the reservoir, and an extractor facing the emitter for extracting and accelerating the ions from the emitter, wherein the base is impermeable to the propellant at least on said first side and has pores or channels for providing flow of propellant from the reservoir to said projections.

12 Claims, 4 Drawing Sheets

(56) References Cited

OTHER PUBLICATIONS

International Search Report with Written Opinion of the International Search Authority in corresponding International Application No. PCT/AT2018/060159, dated Sep. 27, 2018.
International Preliminary Report on Patentability in corresponding International Application No. PCT/AT2018/060159, dated Jun. 16, 2020.

* cited by examiner

ION THRUSTER

CROSS-REFERENCE TO RELATED APPLICATIONS

This application is a National Phase application of International Application No. PCT/AT2018/060159 filed Jul. 24, 2018 which claims priority to Austrian Patent Application No. A 60138/2017 filed Dec. 12, 2017, the disclosures of which are incorporated herein by reference.

TECHNICAL FIELD

The disclosed subject matter relates to an ion thruster, in particular to an ion thruster for propulsion of spacecrafts.

BACKGROUND

Increased sophistication of missions for pico- and nano-satellites or general spacecrafts requires efficient and light-weight propulsion systems. For proper attitude, magnetorquers, tethers or reaction wheels are insufficient and do not allow, e.g., flight formation or any other mission which requires change of speed ($\Delta v$) capabilities. Small spacecrafts with tight power and mass budgets are reluctant to embed chemical or cold-gas based propulsion systems due to their limited specific impulse.

Electric propulsion systems offer a promising alternative. Avoiding moving parts drastically reduces system complexity and thus guarantees high reliability and durability. For example, ion thrusters and in particular field-emission electric propulsion (FEEP) systems are highly attractive for missions with increased specific impulse demands.

Ion thrusters create thrust by electrically accelerating ions as propellant; such ions can be generated, e.g., from neutral gas (usually xenon) ionized by extracting electrons out of the atoms, from liquid metal, or from an ionic liquid. Field-emission electric propulsion (FEEP) systems are based on field ionization of a liquid metal (usually either caesium, indium, gallium or mercury). Colloid ion thrusters, also known as electrospray thrusters, use ionic liquid (usually room temperature molten salts) as propellant.

The emission sites of ion thrusters are projections which have the shape of cones, pyramids, triangular prisms, or the like. To achieve the strong electric field necessary for ion extraction, the projections are sharp-tipped or sharp-edged to utilize the field-concentrating effect of the tip or edge.

Applying a strong electric field to such a sharp tip or edge causes the formation of a so-called Taylor cone on top of the tip or edge of the emitter's projection. In FEEP ion thrusters, neutral atoms of liquid metal at the apex of the Taylor cone evaporate from the surface. In the strong electric field between the emitter and the extractor, due to field emission negative electrons tunnel back to the surface, changing the formerly neutral atoms to positively charged ions. The thusly created ions are extracted from the Taylor cone and accelerated by the electric field. This principle of creating positive ions and accelerating them by the very same electric field is used to generate thrust. In colloid ion thrusters, already charged ions of an ionic liquid are extracted from the Taylor cone and accelerated by the electric field. The thrust can be controlled by the strength of the electric field. The sharper the emission site, the smaller is the base of the Taylor cone, leading to a higher efficiency of the thruster at any given ion current.

For transporting propellant to the sharp tip or edge of each projection passive forces, like capillary effects, and/or external forces, like pressure differences or centrifugal forces, are employed.

Three different types of emitters for transporting and emitting propellant are known. Firstly, emitters with solid projections, e.g. needles, are used, wherein the emitter and its projections have surfaces which are wetted by the propellant. Due to adhesion on the wetting surface of the emitter, the emitter and each projection is covered with a film of propellant. This technology is particularly attractive in terms of performance as the propellant flow impedance is high, but is also very prone to contamination or any effects that could com-promise or disrupt the propellant film. Solid emitter projections of this type are known, e.g., from US 2011/192968 A1 or US 2009/114838 A1 for colloid ion thruster applications.

Secondly, nozzle-type emitters with projections penetrated by capillary channels are used for propellant transport. Such capillary emitters have the advantage that the projections are resistant to contamination and the manufacturing is simple and reliable. This type of projections is known, e.g., from AT 500412 A1, U.S. Pat. No. 4,328,667 B for FEEP ion thrusters or from K. Huhn et al, "Colloid Emitters in Photostructurable Polymer Technology: Fabrication and Characterization Progress Report", IEPC-2015-120, July 2015 for a salt-based colloid ion thruster. However, the exit opening of the capillary needs a minimum diameter mainly governed by manufacturing capabilities, thus leading to a larger Taylor cone and, hence, to lower efficiency in terms of thrust per propellant mass, i.e. a smaller specific impulse. To at least partly counteract this disadvantage, it is known from the cited prior art to cover the tips of the channeled projections with a material that is not wettable by the propellant to reduce the size of the Taylor cone.

Thirdly, porous emitters are known, e.g. from US2016/0297549 A1 or D. Krejci et al., "Design and Characterization of a Scalable Ion Electrospray Propulsion System", IEPC-2015-149, July 2015 for ionic liquid ion thrusters. The material of the porous emitters and the projections thereof is wetting in respect to the propellant used. Such porous emitters combine the advantages of said first and second types of emitters as the porous projections transport high volume of propellant both inside and on their outer surfaces and allow for sharp tips or edges. Hence, porous projections offer both high specific impulse and robustness against contamination and the ion thrust can be precisely controlled. Using such porous emitters in long-term operation may, however, lead to undesirable loss of propellant or other functional and performance degradation or impairment which sometimes even causes a system breakdown.

BRIEF SUMMARY

It is thus an object of the disclosed subject matter to provide an ion thruster which is not only efficient and reliable but also durable.

This object is achieved with an ion thruster for propulsion of spacecrafts, comprising a reservoir for a propellant, an emitter for emitting ions of the propellant, the emitter having one or more projections of porous material and a base with a first side supporting said projections and a second side connected to the reservoir, and an extractor facing the emitter for extracting and accelerating the ions from the emitter wherein the base is impermeable to the propellant at least on said first side supporting said projections and has pores or channels for providing flow of propellant from the reservoir to said projections.

The disclosed subject matter is based on the finding that the functional degradation or impairment as well as the loss of propellant in porous emitter type thrusters is a consequence of uncontrolled accumulation of propellant on the base between and around the porous projections due to propellant seeping through the base. This also leads to system breakdown in long-term operation. By making said first side of the base entirely impermeable to propellant, said seeping through the base and the accumulation of propellant can effectively be prevented and functional degradation or system breakdown can be avoided in the long-run as well as during manufacturing and ground-handling. Still, the advantage of the porous projections in terms of specific impulse and robustness against contamination is maintained.

In an advantageous embodiment, the entire base is made of a material impermeable to the propellant. Such a base can be manufactured easily and is reliable in use. While being impermeable for the propellant, the base is provided with porous or open channels connecting the projections with the reservoir for providing the necessary flow of propellant.

Optionally, the pores or channels of the base are covered with a material that is wettable by the propellant, which intensifies the capillary effect for ensuring passive propellant flow.

Alternatively or in addition thereto, it is favorable when said first side is coated with a coating impermeable to the propellant. Thereby, the base can be manufactured from a wide variety of materials—even from the same, particularly porous, material as the projections, which effectuates a very smooth flow of propellant. Nevertheless, the coating is entirely impermeable to the propellant, i.e., when made of porous material, the pores are blocked by the coating. If desired, the base and the projections can be a single, unitary piece of porous material manufactured in one step or, on the other hand, be separately manufactured and then connected, e.g. by additive manufacturing, welding or the like.

In an embodiment thereof, the coating extends over an adjacent portion of each projection. Hence, the projections can be arranged closer to one another on the base without accumulation of propellant between the projections. While keeping the same maximum thrust of the ion thruster, the size of the emitter can thereby be further reduced.

To prevent propellant from leaking at the connection of the emitter to the reservoir, it is beneficial when the coating extends over an adjacent portion of the reservoir.

The coating can be made of a wide variety of materials which also depend on the propellant. In an embodiment, said coating is also repellent to the propellant. Such a coating which is repellent to the propellant, i.e. non-wetting, prevents possible dripping of propellant from the projections and/or creeping of propellant along the surface. Thereby, the reliability of the ion thruster is further increased. Optionally, the coating is made of an epoxy resin, which has proven to be simple in use and reliable.

In a favorable embodiment the base and the projections are made of porous tungsten. Tungsten is very durable and can be produced having fine pores and sharp tips or edges. Moreover, when using liquid indium as propellant, tungsten also provides excellent wetting characteristics for the propellant, thereby increasing the reliable passive force of the capillary effect for transporting propellant within the ion thruster.

While the projections may be sharp-edged triangular prisms or sharp-tipped pyramids, in an advantageous embodiment the projections are needle-shaped, i.e. narrow, pointed cones. This shape effectuates a small Taylor cone and the circular cross section of the cones facilitates a homogenous flow of propellant.

In an optional embodiment the emitter has a multitude of projections arranged in a circle on said first side. Thereby, a single circular window in the extractor can be provided to generate a uniform electric field for all projections simultaneously. This is easier in manufacturing and alignment with the projections than a separate window in the extractor for each projection, which is common practice for ion thrusters.

For facilitating the flow of propellant, the reservoir optionally comprises an internal propellant guiding structure which leads to said second side of the base.

BRIEF DESCRIPTION OF THE DRAWINGS

The disclosed subject matter shall now be explained in more detail below on the basis of an exemplary embodiment thereof with reference to the accompanying drawings, in which.

DETAILED DESCRIPTION

Figure 1A:
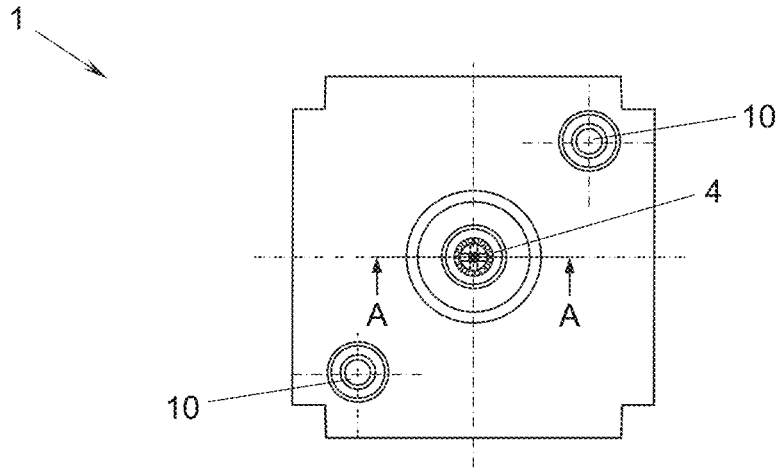
FIGS. 1*a* and 1*b* show an example of an ion thruster according to the disclosed subject matter in a top view (FIG. 1*a*) and in a detail of a longitudinal section along line A-A of FIG. 1*a* (FIG. 1*b*), respectively.
Figure 1B:
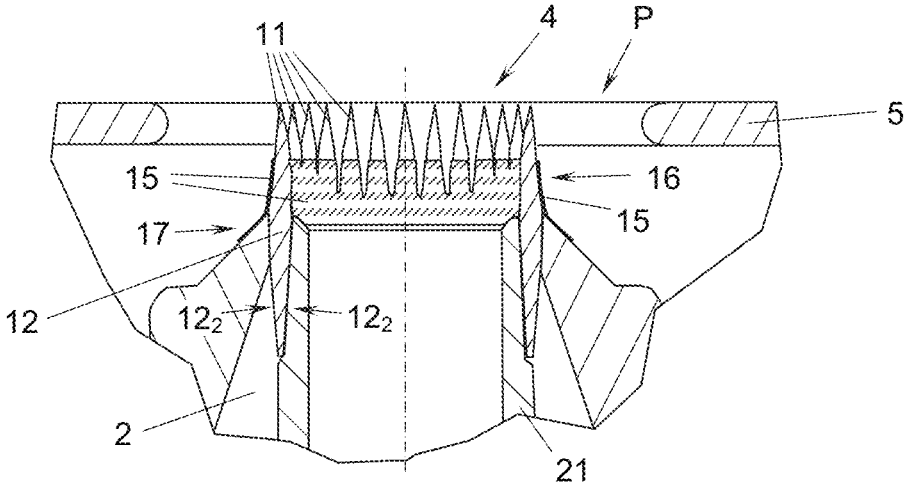
Figure 2A:
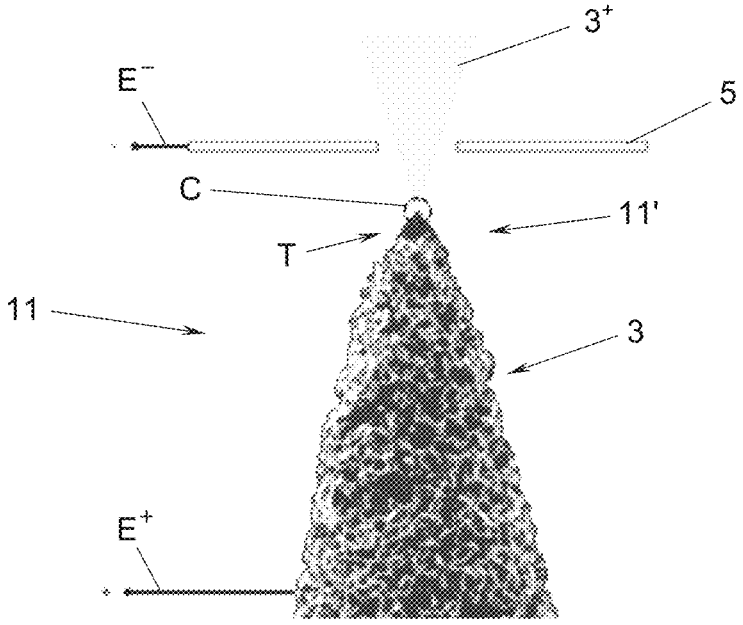
FIGS. 2*a* and 2*b* show a porous emitter projection of the ion thruster of FIGS. 1*a* and 1*b* in a longitudinal section (FIG. 2*a*) and a detail C of FIG. 2*a* (FIG. 2*b*)
Figure 2B:
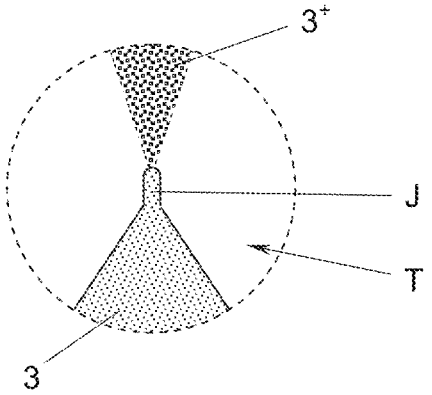

FIGS. 1*a* and 1*b* show an ion thruster 1 for propulsion of spacecrafts, particularly satellites. The ion thruster 1 comprises a reservoir 2—herein also called tank—for a propellant 3 (FIGS. 2*a* and 2*b*). The ion thruster 1 further comprises an emitter 4 for emitting ions $\mathbf{3}^+$ of the propellant 3 and an extractor 5 facing the emitter 4 for extracting and accelerating the ions $\mathbf{3}^+$ from the emitter 4.

The ion thruster 1 of FIGS. 1*a* and 1*b* is of field-emission electric propulsion (FEEP) type. Ion thrusters 1 of this type use liquid metal as propellant 3, e.g. caesium, indium, gallium or mercury, which is ionized by field-emission as will be explained in greater detail below. The extractor 5 then extracts and accelerates the generated (here: positive) ions $\mathbf{3}^+$ of the propellant 3 for propulsion of the spacecraft. Moreover, the ion thruster 1 also optionally comprises one or more (here: two) electron sources 10 (also known in the art as "neutralizers") to the sides of the emitter 4 for balancing a charging of the ion thruster 1—and thus of the spacecraft—due to emission of positively charged ions $\mathbf{3}^+$.

Alternatively, the ion thruster 1 may be of colloid type using ionic liquid, e.g. room temperature molten salts, as propellant 3. In this case, the electron sources 10 may not be necessary, as colloid thrusters usually change polarity periodically so that a continued self-charging of the ion thruster 1 and the spacecraft does not occur. In a further alternative, the ion thruster 1 can use gas, e.g. xenon, as propellant 3, which is again ionized by extracting electrons from the atoms.

The emitter 4 has one or more projections 11 and a base 12. The base 12 has a first side $\mathbf{12}_1$ supporting said projections 11 and a second side $\mathbf{12}_2$ connected to the reservoir 2. Each projection 11 can have the shape of a cone, a pyramid, a triangular prism, or the like and has a sharp tip 11' or edge (FIGS. 2*a* to 2*c*), respectively, opposite the base 12. Particularly, each projection could be needle-shaped, i.e. a narrow, pointed cone. Herein, the projections 11 are also referred to as sharp emitter structures or needles.

The emitter 4 shown in FIG. 1*b* has a multitude of needle-shaped projections 11, which are arranged in a circle (FIG. 1*a*) on said first side 121 of the base 12. The base 12 itself is ring-shaped. Thereby, a crown-shaped emitter 4 is formed. Moreover, the extractor 5 has a single aperture P for emission of ions $\mathbf{3}^+$ of the propellant 3 from all projection 11 of the crown-shaped emitter 4. It shall be understood, however, that other shapes of bases 12 and other shapes and arrangements of projections 11 for the emitter 4 and respective extractors 5 may alternatively be chosen. For example, extractors 5 may have a separate aperture for each projection 11 for extracting and accelerating the of ions $\mathbf{3}^+$ from this very projection 11.

FIG. 2*a* shows a projection 11 of the present ion thruster 1, which is made of porous material, e.g., porous tungsten, for transporting propellant 3 to the tip 11' of the projection 11 via capillary forces. Between the projection 11 of the emitter 4 and the extractor 5, a strong electric field in the range of a few kilovolts (kV) is applied by means of electrodes $E^+$, $E^-$. By applying the electric field, a so-called Taylor cone T is formed on the tip 11' of the projection 11.

In FEEP ion thrusters 1 neutral atoms of the liquid metal evaporate from the surface. In the strong electric field at the tip 11' of the Tailor cone T, one or more electrons tunnel back to the surface of the projection 11 due to field-emission, changing the formerly neutral atom to a positively charged ion $\mathbf{3}^+$. In case of colloid ion thrusters 1 with ionic propellant 3, this ionization is not necessary.

As shown in FIG. 2*b*, a further consequence of the strong electric field is that a jet J is formed on the apex of the Tailor cone T, from which the ions $\mathbf{3}^+$ of the propellant 3 are extracted and then accelerated by the extractor 5 generating thrust. Due to the precision at which the voltage between the needle 3 and the extraction electrode $E^-$ can be controlled, the generated thrust can be controlled with high accuracy.

Summing up, in case of FEEP the metallic propellant 3 in the tank 2 is heated above the liquefaction temperature, and capillary forces, by a combination of surface tension, (pore) geometry and wettability of the surface of the reservoir 2 and the emitter 4, feed the propellant 3 from the propellant reservoir 2 towards the emitter 4, and further towards the tips 11' of the sharp emitter structures 11. A high voltage is applied to the liquid propellant 3 with respect to a counter electrode $E^-$, surpassing the threshold of ionization locally at the induced liquid instabilities formed by electrical stresses at the tips 11' of the sharp emitter structures 11. Propellant 3 is therefore extracted, and replenished by capillary forces from downstream.

Figure 3A:
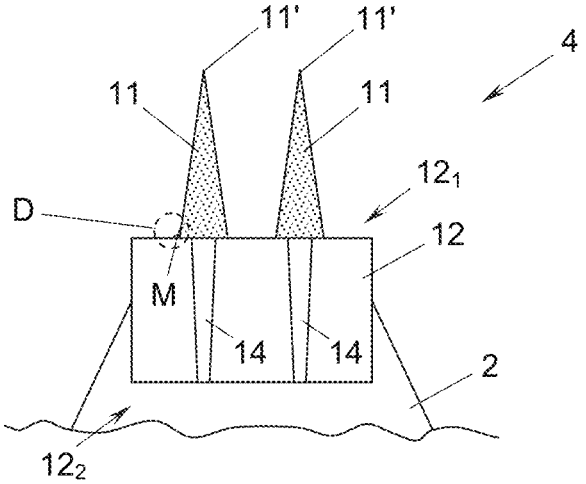
FIGS. 3*a* to 3*d* schematically show three embodiments of the emitter of the ion thruster of FIGS. 1*a* and 1*b*, in respective longitudinal sections (FIGS. 3*a* to 3*c*) and a detail D of FIG. 3*a* (FIG. 3*d*)
Figure 3B:
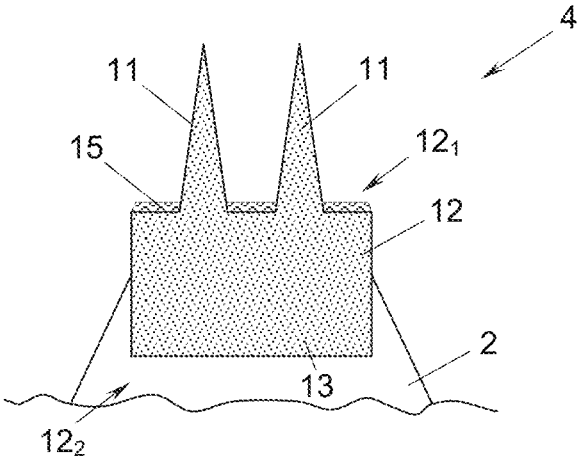
Figure 3C:
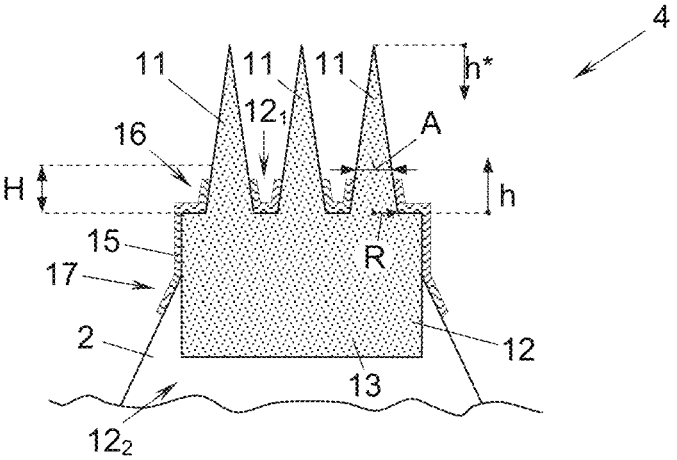

FIGS. 3*a* to 3*c* show three embodiments of the emitter 4 for use in the ion thruster 1. In all three embodiments, however, the base 12 is impermeable to the propellant 3 at least on said first side $\mathbf{12}_1$ thereof as will be explained in detail further down. Thereby, a seeping of propellant 3 through the base 12—at least through said first side $\mathbf{12}_1$ thereof—and a subsequent accumulation of propellant 3 around each projection 11 and/or between two neighboring projections 11 is inhibited. At the same time, the base 12 itself has pores 13 or channels 14 for providing flow of propellant 3 from the reservoir 2 to said projections 11; therefore, the pores 13 or channels 14 connect the reservoir 2 to the projections 11.

In the first embodiment (FIG. 3*a*) of said three embodiments (FIGS. 3*a* to 3*c*), the entire base 12 is made of a material which is impermeable to the propellant 3. For providing flow of propellant 3 from the reservoir 2 to the projections 11, the base 12 in this case has—open or porous—channels 14. The channels 14, when necessary, are optionally covered with a material that is wettable by the propellant 3 for easing the flow of propellant 3 by means of capillary forces.

It is understood, that in a variation of this embodiment, just a part of the base 12, i.e. the first side $\mathbf{12}_1$, can be made of a material impermeable to the propellant 3, while the rest, e.g. the interior, of the base 12 could be permeable (and wettable) by the propellant 3.

In the second embodiment (FIG. 3*b*), said first side $\mathbf{12}_1$ of the base 12 is coated with a coating 15 which is impermeable to the propellant 3. The base 12 may optionally be of the same porous material as the projections 11, in which case the pores 13 are blocked by the coating 15 on said first side $\mathbf{12}_1$. The base 12 can be unitary with the projections 11 as in the example of FIG. 3*b*, or separate therefrom and connected, e.g., glued, additively manufactured or welded, thereto.

In the third embodiment (FIG. 3*c*), which can also be seen as a variation of the aforementioned second embodiment (FIG. 3*b*), the propellant-impermeable coating 15 extends from the first side $\mathbf{12}_1$ of the base 12 over a portion 16 of each projection 11, which portion 16 is adjacent to said first side $\mathbf{12}_1$. Hence, the coating 15 covers the lower base, i.e. the adjacent portion 16, of the projections 11 and the gap between neighboring projections 11, i.e. said first side $\mathbf{12}_1$. Thereby, also seeping of propellant 3 through said lower base of the projections 11 is prevented.

The maximum height H of the coating 15 of said portion 16 of the projection 11 is determined by the necessary flow of propellant 3 and particularly depends on the cross section of the projection 11 and its properties in respect to the propellant 3, which in turn depend on environmental conditions such as temperature: For a projection 11 with a cross section A, whose porous properties are in a manner that a fraction pf*A is available for liquid transport of the propellant 3 with temperature dependent density ρ, and which is used for emitting a current I of charged particles of an average charge-to-mass ratio e/m and a volume flow rate per unit surface area q, the average local flow velocity v at the height of the termination of the coating 15 is given by $$v = \frac{I}{\rho A \cdot pf} \frac{m}{eq} \qquad \text{(eq. 4)}$$

For a projection 11 in the form of a cone, the average local flow velocity v can be described dependent on the height h measured from the base 12 towards the tip 11' of the cone, which is described by the angle φ and radius at the base R, by $$v = \frac{I}{\rho\pi(R - h\tan\varphi)^2 \cdot pf} \frac{m}{eq} \qquad \text{(eq. 5)}$$

For a liquid with temperature dependent viscosity μ, the volume flow rate per unit surface area q for a material with permeability κ, the pressure drop ΔP can be expressed by $$\Delta P = -\frac{\mu}{\kappa} q \quad \text{(eq. 6)}$$

For a conical projection 11, the pressure drop at height h*, which is measured from the tip 11' of the conical projection 11 and is equivalent with the height at which the coating 15 is terminated, is given by $$\Delta P = -\frac{\mu}{2\pi\kappa}\frac{Ie}{\rho m}\frac{1}{1-\cos\varphi}\left(\frac{1}{h^* \cdot \tan\varphi} - \frac{1}{R}\right) \quad \text{(eq. 7)}$$

where ΔP needs to be chosen small enough to allow passive propellant 3 flow through the porous medium, but large enough to enable ion emission with average charge-to-mass ratio e/m required for the operation of the ion thruster 1.

In the third embodiment (FIG. 3*c*), the propellant-impermeable coating 15 further extends from said first side $\mathbf{12}_1$ over an adjacent portion 17 of the reservoir 2. It shall be understood, that the coating 15 on the portion 17 of the reservoir 2 and the coating 15 on the portion 16 of the projection 11 are independent from each other in that the coating 15 can be extended over none of the two portions 16, 17 (resulting in the second embodiment, FIG. 3*b*), over one of the portions 16, 17, or over both portions 16, 17. Moreover, any such coating 15 can optionally be used together with a base 12, at least said first side $\mathbf{12}_1$ of which is made of material impermeable to the propellant 3 as in the first embodiment (FIG. 3*a*), i.e. coating said first side $\mathbf{12}_1$.

In the embodiments of FIGS. 3*a* to 3*c*, the base 12 is, e.g., a cuboid or a cylinder and the second side $\mathbf{12}_2$ of the base 12 connected to the reservoir 2 is opposite to the first side $\mathbf{12}_1$ of the base 12 which supports the projections 11. How-ever, this is not necessary, as the propellant 3 could also flow through the base 12 from, e.g., a lateral side thereof. An example for such a situation is also shown in FIG. 1*b*, where the base 12 of the crown-shaped emitter 4 is ring-shaped with an inner and an outer circumference, one or both of which being said second side $\mathbf{12}_2$ from which flow of propellant 3 from the reservoir 2 is provided to the projections 11 projecting from the top of the ring-shaped base 12, which, in this case, constitutes said first side $\mathbf{12}_1$. Moreover, the emitter 4 in the example of FIG. 1*b* has a coating 15 according to the abovementioned third embodiment (FIG. 3*c*): The coating 15 extends both over the portion 16 of the projections 11 and the portion 17 of the reservoir 2.

Moreover, the propellant-impermeable coating 15 may, optionally, also be repellent, i.e. non-wetting, to the propellant 3. In the present embodiments, the coating 15 is made of an epoxy resin. However, other materials which are impermeable and repellent to the propellant 3 known to the skilled person may be used for the coating 15.

Figure 3D:
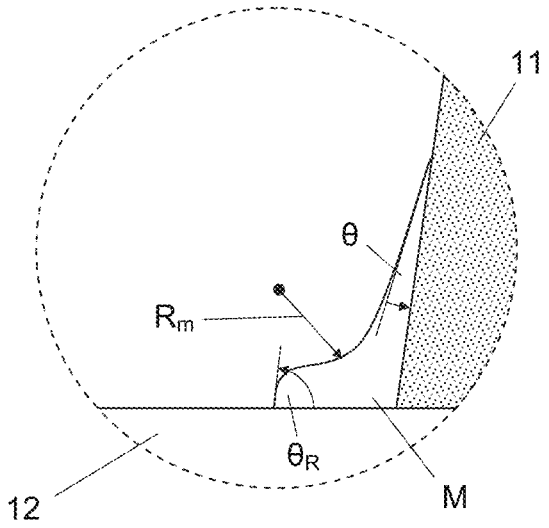

Relating to FIG. 3*d*, the accumulation of propellant 3 is inhibited by preventing propellant 3 seeping through the base 12; this effect can be supported based on the following: The pressure Δp in a meniscus M formed by a liquid propellant 3 of surface tension γ can be described by the Young/Laplace equation:

$$\Delta p = \gamma\left(\frac{1}{R_1} + \frac{1}{R_2}\right) = 2\gamma R_m \quad \text{(eq. 1)}$$

where $R_1$ and $R_2$ are the principal radii of curvature of the menisci M, $R_m$ is the mean curvature, and γ is a function of temperature, which, e.g. for liquid indium, can be described in the form of $$\gamma_{in} = a + bt + ct^2 \quad \text{(eq. 2)}$$

where t is the temperature (in centigrade) and the coefficients (for liquid indium) are:
a=568; b=−0.04; c=−0.0000708.

The relationship between a contact angle θ and the Gibbs interfacial energies 6 between solid and gas (SV), solid and liquid (SL), and liquid and vapor (LV) is given by Young's equation $$\delta_{SV} = \delta_{SL} - \delta_{LV}\cos\theta \quad \text{(eq. 3)}$$

These relationships determine a minimum distance that two adjacent projections 11 shall be separated with, to avoid connection of the two menisci M formed between the base 12 and the projection 11. When the minimum distance is not kept, the force containing the meniscus M around a projection 11 would vanish as the radii increase for a meniscus M that combines with a neighboring meniscus M into one liquid body. Hence, the negative pressure inside the meniscus would decrease and no forces would act that could prevent the liquid accumulation to further increase over time.

As the physical properties of the liquid change with temperature and other environmental conditions, the extent of the minimum distance would need to account for these effects.

The possibility of avoiding the occurrence of growing liquid accumulations in the vicinity of projections 11 and especially between two neighboring projections 11 is to inhibit propellant 3 seeping through the base 12. Avoiding such accumulations can further be supported by providing said first side $\mathbf{12}_1$ of the base 12 with a material that has a larger contact angle θR to the liquid propellant 3 compared to the material of the projections 11 (and optionally the remaining base 12), i.e. the first side $\mathbf{12}_1$ is repellent to the propellant 3. Hence, when the coating 15 is also repellent to the propellant 3, the projections 11 may optionally be closer to each other, as depicted in FIG. 3*c*.

It shall be understood that when the base 12 itself is propellant-impermeable and has a larger uniform area (not shown) and the projections 11 project from merely a sector of this area, not necessarily the whole area but only said sector around each of the projections 11, i.e. particularly between neighboring projections 11, may be coated with said repellent material.

Figure 4:
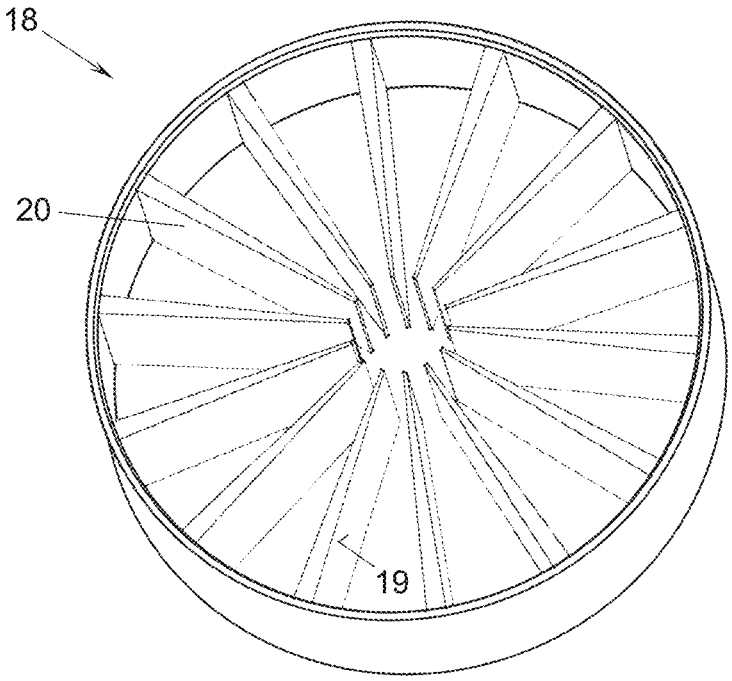
FIG. 4 shows an embodiment of a guiding structure in a propellant reservoir of the ion thruster of FIGS. 1*a* and 1*b* in a perspective view.

On the basis of FIGS. 1*b* and 4 an optional internal guiding structure 18 for the propellant 3 shall be explained.

The guiding structure 18, which is comprised by the reservoir 2, enhances the flow of propellant 3 towards said second side $\mathbf{12}_2$ of the base 12. Therefore, the propellant guiding structure 18 has good wetting characteristics with respect to the propellant 3. In case of indium as propellant 3, the guiding structure 18 is, for example, coated with a layer 19 of tantalum. Tantalum may be applied by a gas phase process like CVD in order to form the layer 19 that is grown into the tank material creating an inseparable nanoscale surface alloy. Such tantalum layer 19 has crystalline features significantly improving the wetting characteristics of indium on the walls of the reservoir 2.

To enhance the passive flow of propellant 3 from the reservoir 2 towards the emitter 4, the guiding structure 18 comprises wettable guiding baffles 20, also referred to as fins, which are introduced into the reservoir 2. These fins 20 lead the propellant 3 either directly to said second side $\mathbf{12}_2$ of the base 12 of the emitter 4, or via an optional central, wettable feed tube 21 (FIG. 1*b*) of the guiding structure 18, which itself is connected to said second side $\mathbf{12}_2$ of the base 12.

The guiding structure 18 also prevents unintended propellant movement inside the reservoir 2 when the propellant 3 is kept in liquid state.

The invention is not restricted to these specific embodiments described in detail herein but encompasses all variants, combinations, and modifications thereof that fall within the frame of the appended claims.

What is claimed is:

1. An ion thruster for propulsion of spacecrafts, comprising:

a reservoir for a propellant, an emitter for emitting ions of the propellant, the emitter having one or more projections of porous material and a base with a first side supporting said one or more projections and a second side connected to the reservoir, and an extractor facing the emitter for extracting and accelerating the ions from the emitter, wherein the base has pores or channels for providing a flow of the propellant from the reservoir to said one or more projections, and further wherein said first side of the base is coated with a coating which is impermeable to the propellant and wherein the one or more projections protrude through the coating.

2. The ion thruster according to claim 1, wherein the pores or channels of the base are covered with a material that is wettable by the propellant.

3. The ion thruster according to claim 1, wherein the coating extends over an adjacent portion of each projection of the one or more projections.

4. The ion thruster according to claim 1, wherein the coating extends over an adjacent portion of the reservoir.

5. The ion thruster according to claim 1, wherein the coating is repellent to the propellant.

6. The ion thruster according to claim 1, wherein the coating is made of an epoxy resin.

7. The ion thruster according to claim 1, wherein the base and the one or more projections are made of porous tungsten.

8. The ion thruster according to claim 1, wherein the one or more projections are needle-shaped.

9. The ion thruster according to claim 1, wherein the one or more projections on the emitter comprise a plurality of projections arranged in a circle on said first side.

10. The ion thruster according to claim 1, wherein the reservoir comprises an internal propellant guide leading to said second side of the base.

11. An ion thruster for propulsion of spacecrafts, comprising:

a reservoir for a propellant, an emitter for emitting ions of the propellant, the emitter having one or more projections of porous material and a base with a first side supporting said one or more projections and a second side connected to the reservoir, and an extractor facing the emitter for extracting and accelerating the ions from the emitter, wherein the base is impermeable to the propellant at least on said first side and has pores or channels for providing a flow of the propellant from the reservoir to said one or more projections, wherein said first side of the base is coated with a coating impermeable to the propellant, and wherein the coating is made of an epoxy resin.

12. An ion thruster for propulsion of spacecrafts, comprising:

a reservoir for a propellant, an emitter for emitting ions of the propellant, the emitter having one or more projections of porous material and a base with a first side supporting said one or more projections and a second side connected to the reservoir, and an extractor facing the emitter for extracting and accelerating the ions from the emitter, wherein the base is impermeable to the propellant at least on said first side and has pores or channels for providing a flow of the propellant from the reservoir to said one or more projections, wherein said first side of the base is coated with a coating impermeable to the propellant, and wherein the base and the one or more projections are made of porous tungsten.

* * * * *